US005086259A

United States Patent [19]

Sakurai et al.

[11] Patent Number: 5,086,259

[45] Date of Patent: Feb. 4, 1992

[54] SYSTEM FOR CONVERGING A PLURALITY OF ELECTRON BEAMS IN CATHODE RAY TUBE

[75] Inventors: Soichi Sakurai, Yokohama; Masaki Nakahara, Chigasaki; Takahisa Mizuta; Nobutaka Okuyama, both of Yokohama; Michitaka Ohsawa, Fujisawa; Ichiro Niitsu, Yokohama, all of Japan

[73] Assignee: Hitachi, Ltd., Tokyo, Japan

[21] Appl. No.: 493,356

[22] Filed: Mar. 14, 1990

[30] Foreign Application Priority Data

Mar. 17, 1989 [JP] Japan ..... 1-63516
Jun. 12, 1989 [JP] Japan ..... 1-146833

[51] Int. Cl.[5] ..... G09G 1/04; H01J 29/70; H01H 1/00

[52] U.S. Cl. ..... 315/368.25; 335/213; 315/368.28

[58] Field of Search ..... 315/368; 335/210, 213

[56] References Cited

U.S. PATENT DOCUMENTS 3,430,099 2/1969 Ashley ..... 315/368
4,642,527 2/1987 Takahashi et al. ..... 315/368
4,725,763 2/1988 Okuyama et al. ..... 315/368

FOREIGN PATENT DOCUMENTS 5027966 8/1967 Japan .
0741348 6/1980 U.S.S.R. ..... 335/213

OTHER PUBLICATIONS

Baumgartner, "Simple Convergence in the New 22-Inch Colour Television Receivers", Grundig Tech Info. (German) No. 5, (1974) pp. 409-412.

*Primary Examiner*—Gregory C. Issing
*Attorney, Agent, or Firm*—Antonelli, Terry, Stout & Kraus

[57] ABSTRACT

A convergence system for a cathode-ray tube having three detection magnetic pole pieces are disposed opposing to each other on both sides of a center beam for forming magnetic paths inside the neck part of a cathode-ray tube. A first convergence yoke is disposed outside the neck part of the cathode-ray tube for forming magnetic paths together with the magnetic pole pieces. A first coil is wound on a first convergence yoke to generate a magnetic field for correcting horizontal misconvergence between the center beam and a side beam on a side of the center beam. A second coil is wound on the first convergence yoke to generate a magnetic field for correcting horizontal misconvergence between the center beam and a side beam on the other side of the center beam. A third coil is wound on the first convergence yoke to generate a magnetic field for correcting vertical misconvergence between the center beam and both side beams. Furthermore, a second convergence yoke is disposed on the neck part of the cathode-ray tube at a different position from the first convergence yoke. A fourth coil is wound on the second convergence yoke to generate a magnetic field for correcting vertical misconvergence between both side beams.

10 Claims, 5 Drawing Sheets

SYSTEM FOR CONVERGING A PLURALITY OF ELECTRON BEAMS IN CATHODE RAY TUBE

BACKGROUND OF THE INVENTION

The present invention relates to a convergence system to be used for a cathode-ray tube which has a plurality of electron beams, especially it relates to a convergence system to be used for a cathode-ray tube which has a plurality of in-line electron beams.

In a conventional convergence system, for example, as described in a Japanese patent application publication No. 50-27966 and the corresponding U.S. Pat. No. 3,430,099, a device for compensating horizontal misconvergence of electron beams and a device for compensating vertical misconvergence of electron beams are constituted separately, and each of them is provided with pole pieces and convergence yokes respectively.

In such a conventional example, it is possible to make convergence adjustment between the beams on both ides of a center beam with the above-mentioned convergence yokes, but it is impossible to make convergence adjustment (comatic aberration correction) between a side beam and the center beam.

In a general color cathode-ray tube, the center beam is a G (green) beam and the beams on both sides are a R (red) beam and a B (blue) beam.

SUMMARY OF THE INVENTION

In the prior art, therefore, even when comatic aberration is produced on the screen of a cathode-ray tube by the unevenness of winding distribution or by the error in the fixing position of an electron gun with respect to that of a deflection yoke, it is impossible to make enough correction for the aberration and satisfactory convergence characteristics cannot be obtained.

An object of the present invention is to provide a convergence system having the functions of horizontal comatic aberration correction and of vertical comatic aberration correction, and also a spot shape of an electron beam is not degraded in the system.

In a convergence system according to the present invention, horizontal comatic aberration correction and vertical comatic aberration correction are both possible, and also because of a uniform magnetic field for correction the deterioration of an electron beam spot is not caused.

BRIEF DESCRIPTION OF THE DRAWINGS

In the accompanying drawings:

FIG. 1(*b*) is a cross-sectional view taken along the line A—A' in FIG. 1(*a*);

FIG. 1(*c*) is a cross-sectional view taken along the line B—B' in FIG. 1(*a*);

FIG. 3(*b*) is a cross-sectional view taken along the line A—A' in FIG. 3(*a*);

FIG. 4(*b*) is a cross-sectional view taken along the line A—A' in FIG. 4(*a*);

FIG. 5(*b*) is a cross-sectional view taken along the line A—A' in FIG. 5(*a*).

DETAILED DESCRIPTION OF THE PREFERRED EMBODIMENTS

Figure 1A:
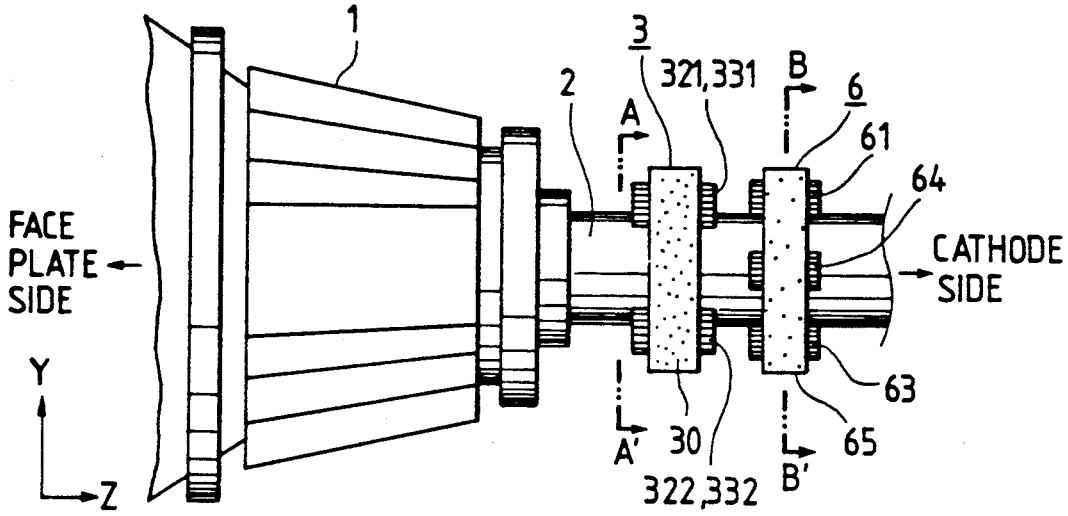
FIG. 1(*a*) is a side view of a convergence system in a first embodiment according to the present invention.
Figure 1B:
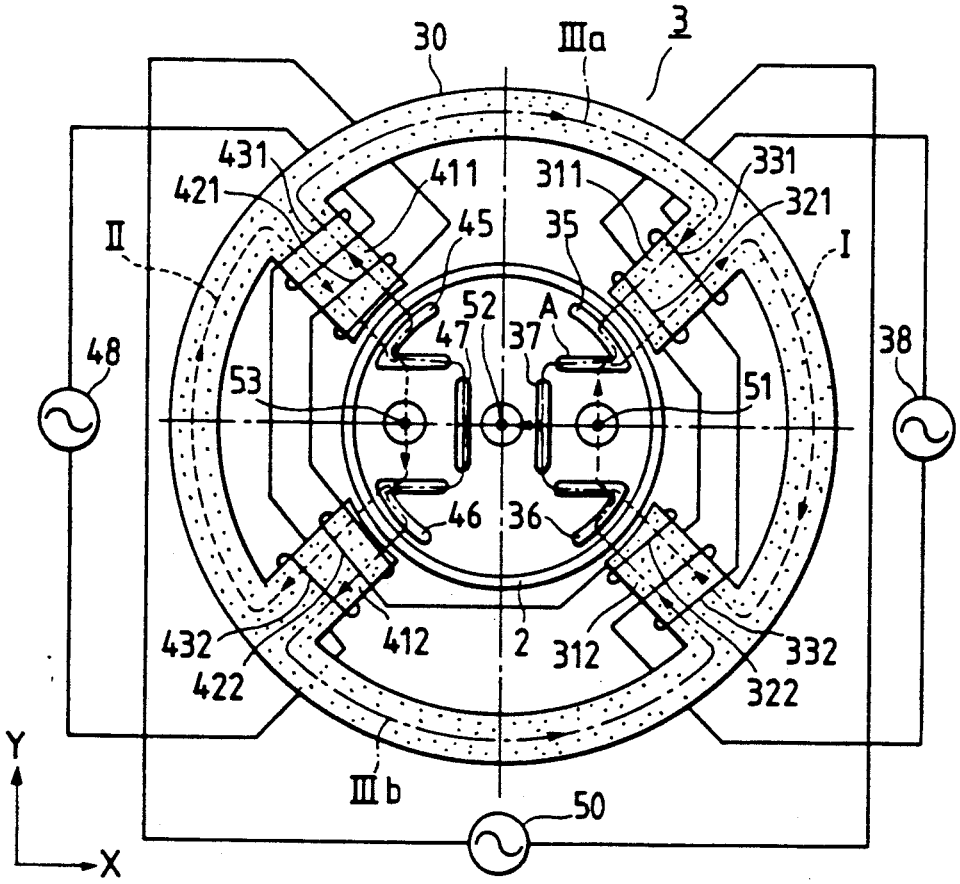
Figure 1C:
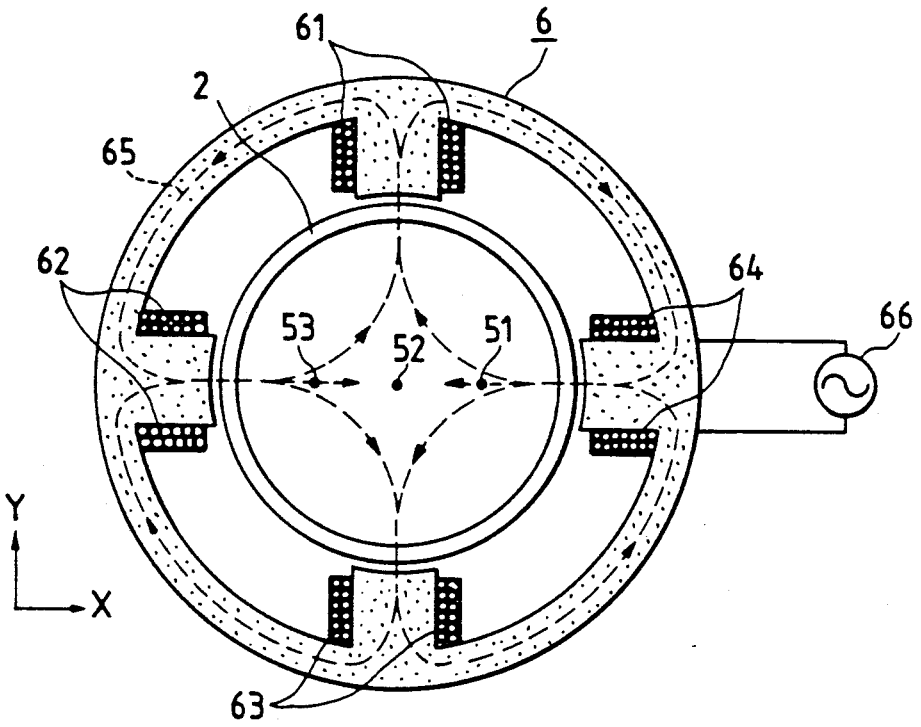

FIGS. 1(*a*), 1(*b*) and 1(*c*) show a convergence system in the first embodiment according to the present invention. FIG. 1(*a*) is a side view showing the dispositions of a deflection yoke and a convergence yoke. FIG. 1(*b*) is a cross-sectional view taken along the line A—A' in FIG. 1(*a*), and FIG. 1(*c*) is a cross-sectional view taken along the line B—B' in FIG. 1(*a*).

In FIG. 1(*a*), a reference numeral 1 shows a deflection yoke, 2 shows a neck tube of a cathode-ray tube, 3 shows a first convergence yoke and 6 shows a second convergence yoke; the deflection yoke 1, the first convergence yoke 3 and the second convergence yoke 6 are disposed on the neck tube 2 in order from a face plate side toward a cathode side.

In FIG. 1(*b*), the first convergence yoke 3 comprises a tetrapole core 30 having an approximately ring shaped outer periphery, first coils 331 and 332, second coils 431 and 432, and third coils 321, 322, 421 and 422; the above-mentioned coils are wound on magnetic poles 311, 312, 411 and 412 respectively. The first coils 331 and 332 are connected in series, similarly the second coils 431 and 432 are connected in series, and the third coils 321, 322, 421 and 422 are connected in series.

Reference numerals 51, 52 and 53 are electron beams for R (red), G (green) and B blue) (52 is the center beam G, and 51 and 53 are side beams R and B); 35, 36, 37, 45, 46 and 47 are magnetic pole pieces disposed inside the neck tube 2; 38, 48 and 50 are driving circuits for supplying exciting currents for convergence. The second coils 431 and 432 are connected to the convergence driving circuit 48, and the third coils 321, 322, 421 and 422 are connected to the driving circuit 50.

Figure 2:
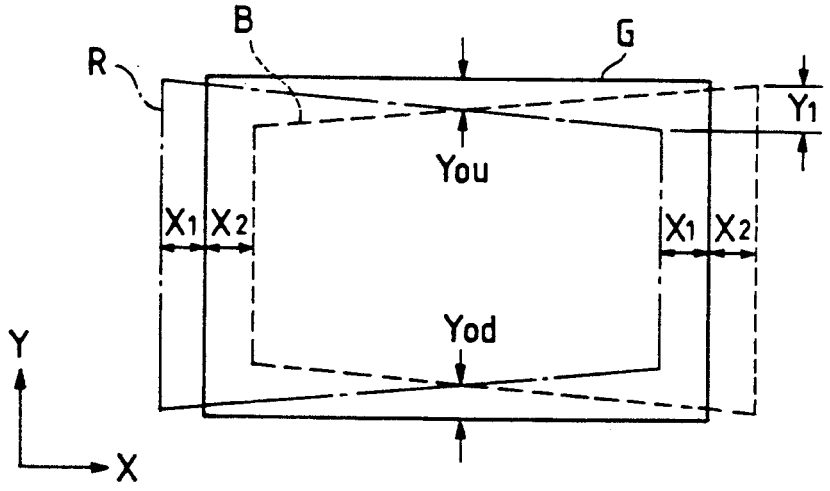
FIG. 2 shows the shapes of rasters scanned by three electron beams in a misconvergence state.

The operation principle of the first convergence yoke 3 in the constitution as described in the above will be explained in detail in the following. Preceding the explanation, however, misconvergence patterns in a deflection system constituted as shown in FIG. 1 are shown in FIG. 2 and the explanation on them will be given. FIG. 2 is an illustrative drawing showing the patterns of rasters to be observed on a screen of a cathode-ray tube by electron beams R, G and B when any convergence correction is not made in a deflection system shown in FIGS. 1(*a*), 1(*b*) and 1(*c*).

It will be observed in FIG. 2 that by adopting the pattern of the center beam G (full line) as a standard, the pattern of a side beam R (one-dot chain line) and the pattern of another side beam B (broken line) are deviated from the standard; the deviation is the misconvergence.

There are four kinds of misconvergence, the vertical misconvergence between both side beams R and B and the center beam G (You and Yod), the horizontal misconvergence (Xl) between the side beam R and the center beam G, the horizontal misconvergence (X2) between the side beam B and the center beam G, and the vertical misconvergence (Yl) between the beams R and B on both sides.

The operation principle of the first convergence yoke 3 is explained referring to FIG. 1(*b*) and FIG. 2 in the following.

In FIG. 1(*b*), a broken line I shows a magnetic field generated by the first coils 331 and 332. The magnetic field generated by the first coils 331 and 332 passes through the outer periphery of the tetrapole core 30, enters the magnetic pole piece 36 from the tip of the magnetic pole 312, passes through the magnetic pole pieces 37 and 35, and again enters the outer periphery of the tetrapole core 30. A magnetic field generated by the second coils 431 and 432, shown by a broken line II, passes through the outer periphery of the tetrapole 30, enters a magnetic pole piece 45 from the tip of the magnetic pole 411, passes through the magnetic pole pieces 47 and 46, and again enters the outer periphery of the tetrapole core 30.

In the vicinities of the R electron beam 51 and the B electron beam 53 at the first convergence yoke 3, magnetic fields expressed by broken lines I and II remain only in Y direction and their polarities are opposite. In other words, the misconvergence Xl shown in FIG. 2 can be corrected by adjusting the magnetic field expressed by the broken line I shown in FIG. 1(*b*); in the similar way to the above the misconvergence X2 shown in FIG. 2 can be corrected by adjusting the magnetic field expressed by the broken line II.

In FIG. 1(*b*), a one-dot-chain line IIIa shows a magnetic field generated by the third coils 321 and 421, and a one-dot-chain line IIIb shows a magnetic field generated by the third coils 322 and 422. A magnetic field IIIa generated by the third coils 321 and 421 passes through the upper part outer periphery of the tetrapole core 30, enters magnetic pole pieces 35 and 37 from the tip of the magnetic pole 311, passes through magnetic pole pieces 47 and 45, and enters the tetrapole core 30 from the tip of the magnetic pole 411. A magnetic field IIIb generated by the third coils 322 and 422 passes through the lower outer periphery of the tetrapole core 30, enters the magnetic pole pieces 36 and 37 from the tip of the magnetic pole 312, passes through magnetic pole pieces 47 and 46, and again enters the tetrapole core 30 from the tip of the magnetic pole 412.

The above-mentioned magnetic fields IIIa and IIIb almost do not act on the R and B electron beams 51 and 53 due to the existence of magnetic pole pieces 35, 36, 45 and 46, and these magnetic fields act only on the G electron beam 52 as magnetic fields in X direction due to the existence of the magnetic pole pieces 37 and 47. In short, the magnetic fields shown with one-dot-chain lines described in the above can correct the misconvergence You shown in FIG. 2. In the case of the magnetic fields shown with one-dot-chain lines, the third coils 321, 322, 421 and 422 are energized to produce magnetic fields in the direction of arrows shown in FIG. 1(*b*), but when a current is made to flow in the opposite direction, magnetic fields in the opposite direction to the direction of arrow are generated; in this case the misconvergence Yod shown in FIG. 2 can be corrected.

The bottom parts A of the magnetic pole pieces 35, 36, 45 and 46 have shapes which are parallel to X axis, and those of the magnetic pole pieces 37 and 47 have shapes parallel to Y axis, so that the convergence correcting magnetic fields shown with broken lines and one-dot-chain lines form almost uniform magnetic fields in the vicinities of R, G and B electron beams 51, 52 and 53. This means that even if convergence correction is made, an electron beam spot is not deteriorated and the focusing function is maintained in a good state.

FIG. 1(*c*) is a cross-sectional view taken along the line B—B' in FIG. 1 (*a*). In FIG. 1(*c*), reference numerals 61, 62, 63 and 64 denote fourth coils, 65 denotes a core, 66 denotes a driving circuit for supplying an exciting current for convergence, and broken lines show magnetic fields generated by the fourth coils 61, 62, 63 and 64, each of these coils being connected to the convergence driving circuit 66. Magnetic fields shown by broken lines form two resultant magnetic fields of opposite polarities in X axis direction as shown with full lines in the vicinities of R and B electron beams 51 and 53. Therefore the misconvergence Yl shown in FIG. 2 can be corrected by adjusting the magnetic fields shown with broken lines in FIG. 1(*c*).

The above-mentioned convergence driving circuits 38, 48, 50 and 66 generate currents synchronizing with horizontal and vertical deflection periods and can be constituted, for example, with a digital convergence circuit which has a digital memory and is capable of generating an arbitrary correction waveform or with an analog circuit which generates correction waveform by integrating or differentiating horizontal or vertical synchronizing pulse voltages.

Figure 3A:
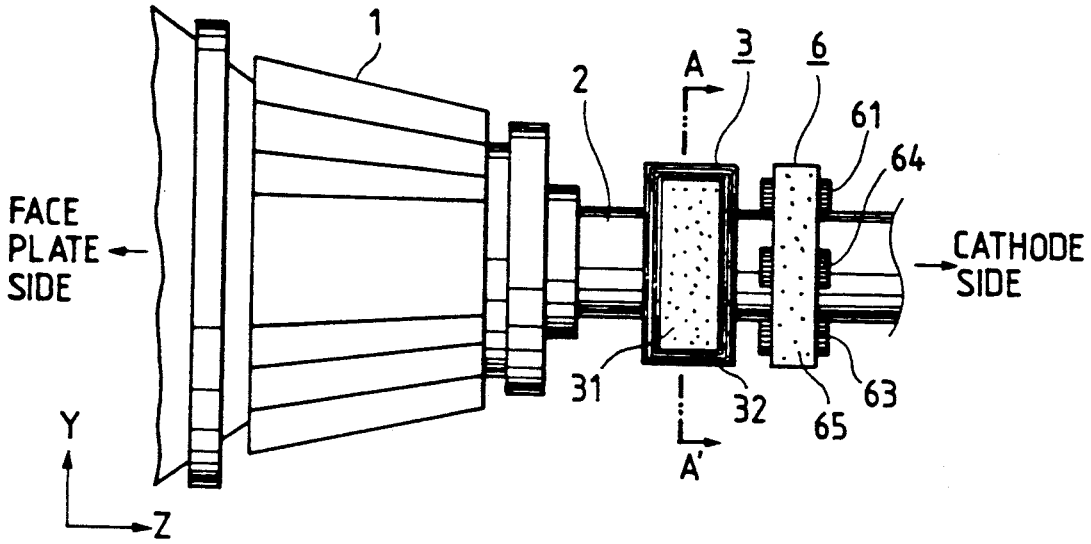
FIG. 3(*a*) is a side view of a convergence system in a second embodiment according to the present invention.
Figure 3B:
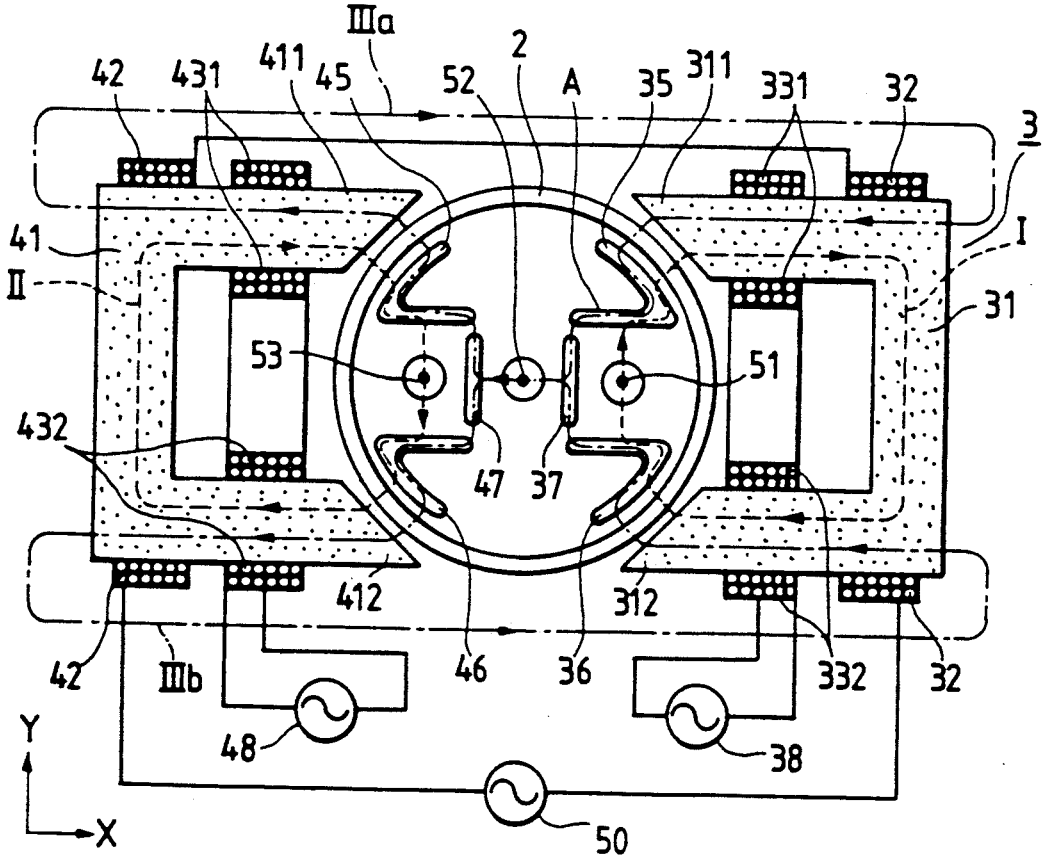

FIG. 3(*a*) and 3(*b*) show a convergence system in a second embodiment according to the present invention. In FIG. 3(*a*) and 3(*b*), those parts having the same reference numerals as those in FIG. 1(*a*) and FIG. 1(*b*) perform similar operations to the parts in the first embodiment shown in FIG. 1(*a*) and FIG. 1(*b*).

The different points of the second embodiment from the first embodiment according to the present invention are that the cores of the first convergence yoke 3 are constituted with a core 31 having magnetic poles 311 and 312, and a core 41 having magnetic poles 411 and 412, and that the third coils 321 and 322 in the first embodiment are put together to form a coil as a coil 32 and the third coils 421 and 422 are also put together to form a coil as a coil 42 as shown in FIG. 3(*b*). The coil 32 is wound on the right end part of the core 31 as if it straddles on the magnetic poles 311 and 312, and the coil 42 is wound on the left end part of the core 41 as if it straddles on the magnetic poles 411 and 412 as shown in FIG. 3(*b*).

The actions to be exerted by the magnetic fields I, II, IIIa and IIIb on the electron beams 51, 52 and 53 shown in FIG. 3(*b*) are identical to the actions exerted by the magnetic fields I, II, IIIa and IIIb shown in FIG. 1(*b*).

The constitution of the second convergence yoke 6 in the second embodiment is identical to the second convergence yoke 6 in the first embodiment.

The magnetic fields IIIa and IIIb shown in FIG. 3(*b*) enter the core 31 from the core 41 respectively through the outsides of the cores. When the core 41 and 31 are connected with two yokes to be the paths of two flows of magnetic flux, one passing through the upper outside of the core and the other passing through the lower outside of the core as shown in the drawing illustrating the core 41 and the core 31, a better first convergence yoke 3 can be obtained.

Figure 4A:
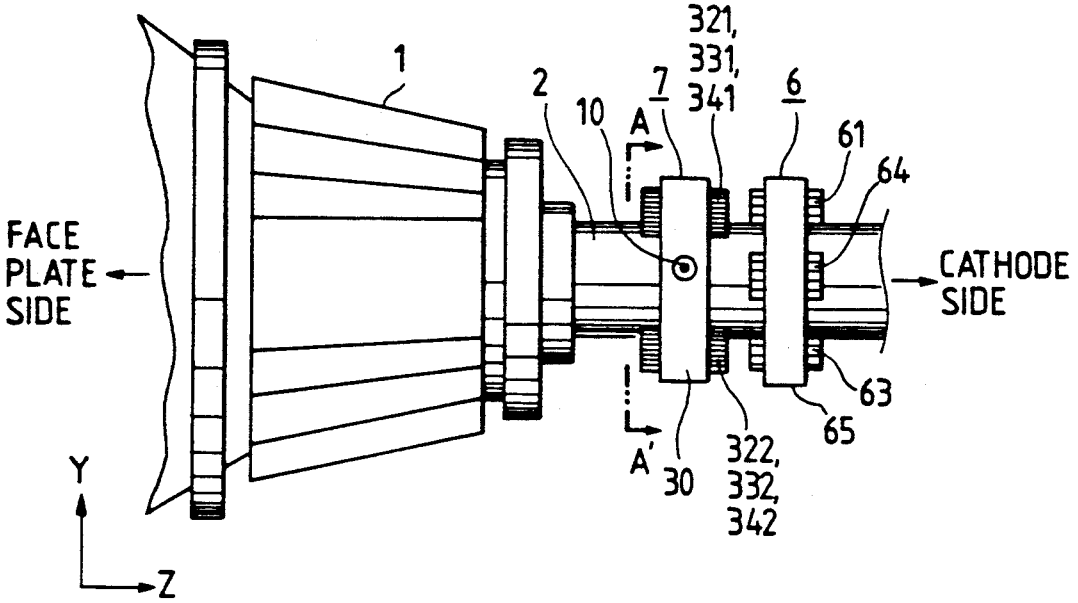
FIG. 4(*a*) is a side view of a convergence system in a third embodiment according to the present invention.
Figure 4B:
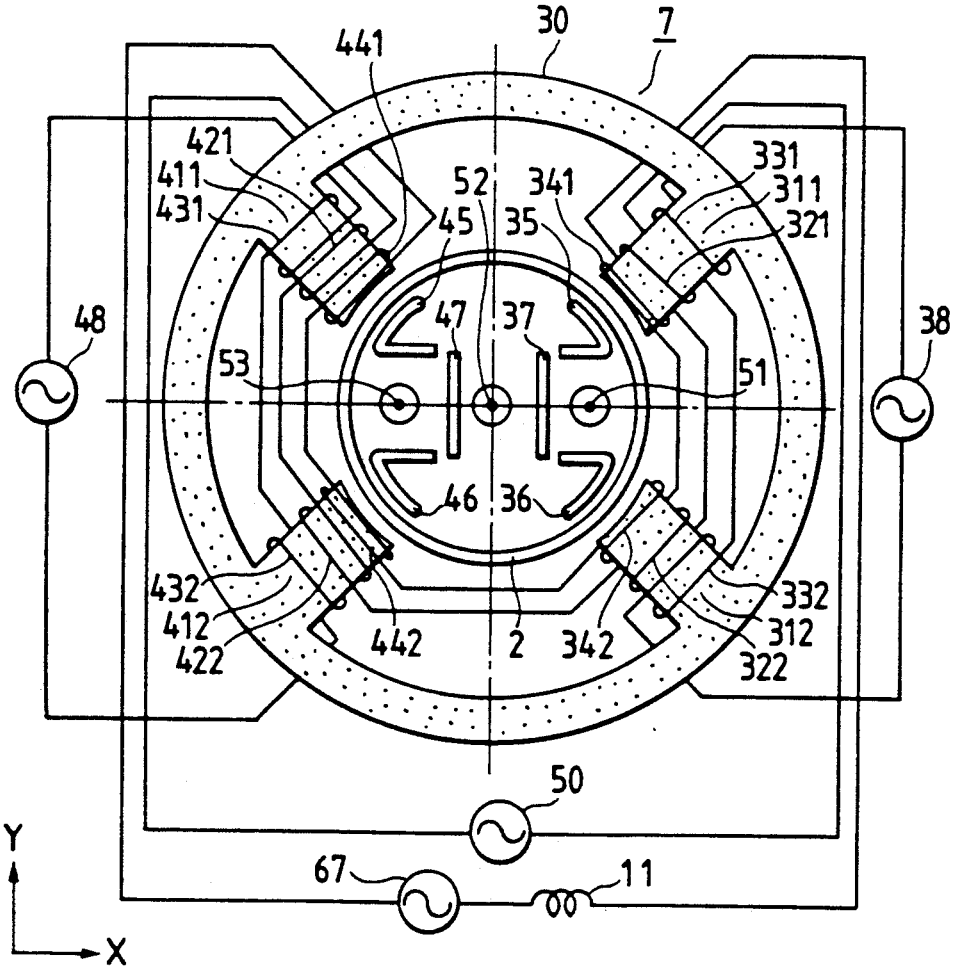

FIG. 4(*a*) and 4(*b*) show a convergence system in a third embodiment according to the present invention. FIG. 4(*a*) is a side view showing the locations of a deflection yoke and a convergence yoke, and FIG. 4(*b*) is a cross-sectional view taken along the line A—A' shown in FIG. 4(*a*). In FIGS. 4(*a*) and 4(*b*), those parts having the same reference numerals as those in FIGS. 1(*a*) and 1(*b*) have the similar functions to those of the parts shown in FIGS. 1(*a*) and 1(*b*).

A remarkable feature of a third embodiment is that fourth coils 341, 342, 441 and 442 are provided.

In FIG. 4(*b*), the fourth coils 341, 342, 441 and 442 are wound on the magnetic poles 311, 312, 411 and 412 of the tetrapole core 30, and they are connected in series, and further they are connected to a vertical deflection circuit 67 through a vertical deflection coil 11. Magnetic fields generated by the fourth coils 341, 342, 441 and 442 are similar to the magnetic fields IIIa and IIIb generated by the third coils 321, 322, 421 and 422 which are shown with one-dot-chain lines in FIG. 1(*b*), and their resultant field in the vicinity of the G electron beam 52 is in X direction. In other words, the magnetic fields generated by the fourth coils 341, 342, 441 and 442 can correct the misconvergence You and Yod shown in FIG. 2.

The cause of occurrence of misconvergence You and Yod shown in FIG. 2 is that in FIG. 4(*a*) a leakage magnetic field 10 (making a right angle with the paper surface of vertical deflection magnetic field from the deflection yoke 1 passes through the first convergence yoke 7 and after that it passes through magnetic pole pieces 35, 36, 37, 47, 45 and 46, so that it acts on G electron beam 52 stronger than on R and B electron beams 51 and 53. It is therefore preferable to supply the fourth coils 341, 342, 441 and 442 with a current having the similar waveform to that of the vertical deflection coil.

As described in the above, the power loss in the convergence driving circuit 50 is improved in comparing with the case of the embodiment shown in FIG. 1 by providing the fourth coils 341, 342, 441 and 442. The second convergence yoke 6 in the fourth embodiment is similar to the one shown in FIG. 1(*c*).

Figure 5A:
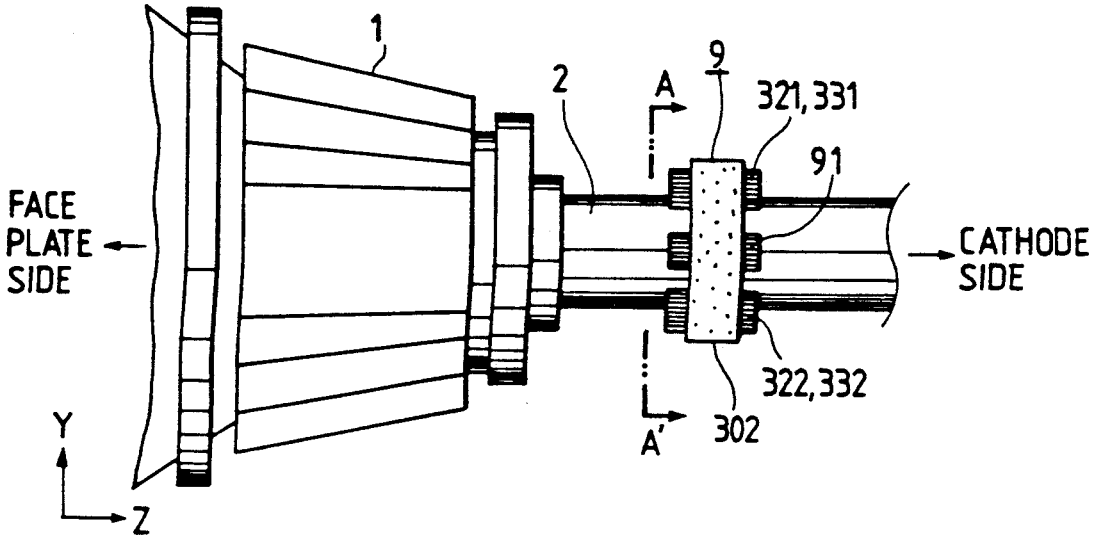
FIG. 5(*a*) is a side view of a convergence system in a fourth embodiment according to the present invention.
Figure 5B:
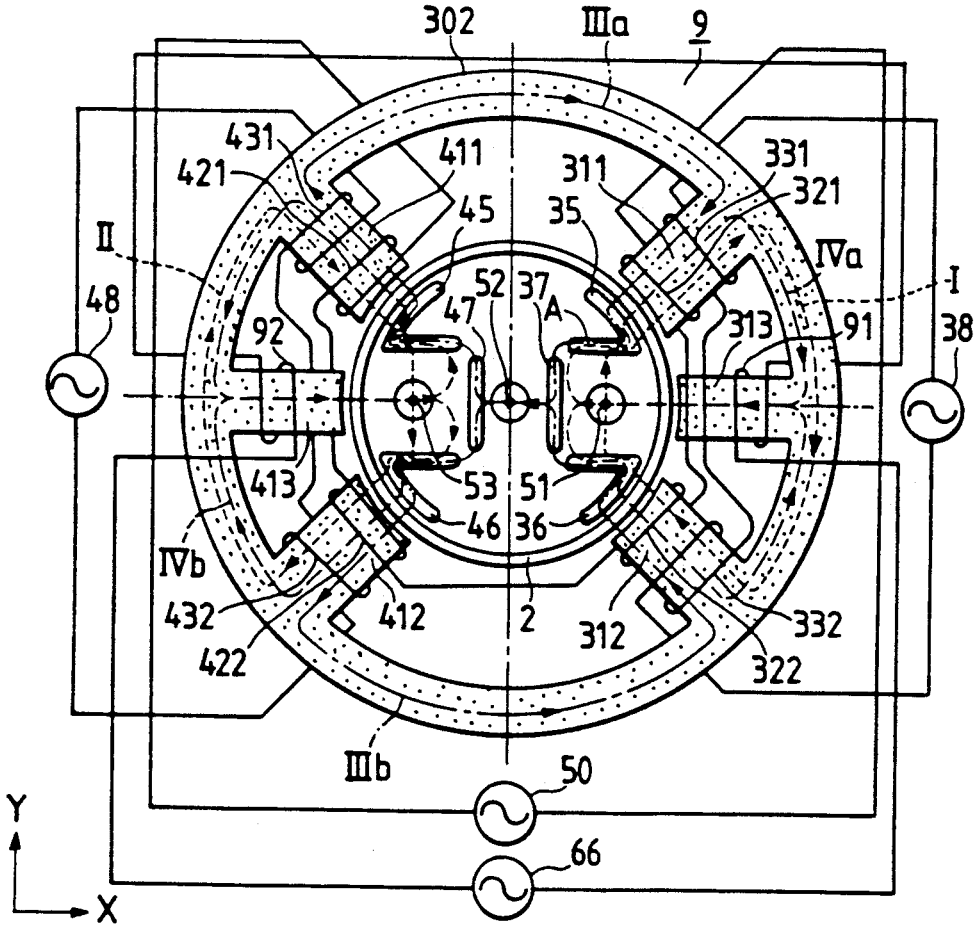

FIGS. 5(*a*) and 5(*b*) show a convergence system in a fourth embodiment according to the present invention. FIG. 5(*a*) is a side view showing the locations of a deflection yoke and a convergence yoke. FIG. 5(*b*) is a cross-sectional view taken along the line A—A' in FIG. 5(*a*). In FIGS. 5(*a*) and 5(*b*) those parts having the same reference numerals as those in FIGS. 1(*a*) and 1(*b*) work in the similar way to those in FIGS. 1(*a*) and 1(*b*).

A remarkable feature of the fourth embodiment is that magnetic poles 313, 413 are provided on a core 302 in its X axis direction in the convergence yoke 9, that is, the core 302 is a hexapole core; on the magnetic poles 313 and 413 fifth coils 91 and 92 are provided, and the second convergence yoke 6 which is needed in the first to third embodiments is not needed in this embodiment. The operation of the fourth embodiment will be explained in detail in the following.

In FIG. 5(*b*), the fifth coils 91 and 92 are connected in series and further they are connected to a driving circuit 66 which supplies an exciting current for convergence. Magnetic fields expressed by broken lines IVa and IVb are generated by the fifth coils 91 and 92, and each of these magnetic fields passes through the magnetic pole 313 or 413, passes through the vicinities of R and B electron beams in X axis direction, passes through magnetic pole pieces 35 and 36, or 45 and 46, enters magnetic poles 311 and 312, or 411 and 412, passes through the outer periphery of the core 302, and again enters the magnetic pole 313 or 413. The winding directions of the fifth coils 91 and 92 are decided so that these magnetic fields can be in the direction of X axis and opposite in polarities to each other in the vicinities of R electron beam 51 and B electron beam 53.

Therefore the misconvergence Yl shown in FIG. 2 can be corrected by the above-mentioned magnetic fields shown with broken lines IVa and IVb.

The fourth embodiment is able to dispense with the second convergence yoke 6 shown in FIG. 1(*c*), so that the system can be simplified, the total length of the neck tube 2 in the Z axis direction can be shortened, and the focusing function can be improved.

As described in the above, owing to the present invention, horizontal and vertical misconvergence of both side beams (R and B) can be corrected, which makes it possible to realize high precision convergence function on the whole screen. When a arbitrary current-waveform generator synchronizing with horizontal and vertical synchronizing pulses is applied higher precision convergence function can be realized.

Owing to the magnetic pole pieces provided in an electron gun, as convergence correction magnetic fields are made uniform, the deterioration of a beam spot can be almost avoided.

We claim:

1. A system for generating magnetic fields to converge a plurality of electron beams in a cathode-ray tube comprising:

magnetic pole pieces disposed on both sides of a center electron beam opposing each other for forming magnetic paths inside the neck part of said cathode-ray tube;

a first convergence yoke disposed on the outside of the neck part of said cathode-ray tube for forming magnetic paths together with said magnetic pole pieces;

a first coil wound on said first convergence yoke for generating a magnetic field for correcting horizontal misconvergence between said center electron beam and a side electron beam located on a side of said center electron beam, and a driving circuit for supplying an exciting current to the first coil;

a second coil wound on said first convergence yoke for generating a magnetic field for correcting horizontal misconvergence between said center electron beam and a side electron beam located on the other side of said center electron beam, and a driving circuit for supplying an exciting current to the second coil;

a third coil wound on said first convergence yoke for generating a magnetic field for correcting vertical misconvergence between said center electron beam and said both side electron beams, and a driving circuit for supplying an exciting current to the third coil;

a second convergence yoke disposed in a different position from said first convergence yoke on the neck part of said cathode-ray tube; and a fourth coil wound on said second convergence yoke for generating a magnetic field for correcting vertical misconvergence between said both side electron beams, and a driving circuit for supplying an exciting current to the fourth coil;

wherein said first convergence yoke comprises a core having a ring shaped outer periphery and four magnetic poles on its inner periphery, said first coil is wound on two adjacent magnetic poles out of said four magnetic poles, said second coil is wound on the remaining two adjacent magnetic poles out of said four magnetic poles, and said third coil is wound on said four magnetic poles.

2. A system according to claim 1 wherein said first coil comprises coils wound on said two adjacent magnetic poles and connected in series, said second coil comprises coils wound on said remaining two adjacent magnetic poles and connected in series, and said third coil comprises coils wound on said four magnetic poles and connected in series.

3. A system for generating magnetic fields to converge a plurality of electron beams in a cathode-ray tube comprising:

magnetic pole pieces disposed on both sides of a center electron beam opposing each other for forming magnetic paths inside the neck part of said cathode-ray tube;

a first convergence yoke disposed on the outside of the neck part of said cathode-ray tube for forming magnetic paths together with said magnetic pole pieces;

a first coil wound on said first convergence yoke for generating a magnetic field for correcting horizontal misconvergence between said center electron beam and a side electron beam located on a side of said center electron beam, and a driving circuit for supplying an exciting current to the first coil;

a second coil wound on said first convergence yoke for generating a magnetic field for correcting horizontal misconvergence between said center electron beam and a side electron beam located on the other side of said center electron beam, and a driving circuit for supplying an exciting current to the second coil;

a third coil wound on said first convergence yoke for generating a magnetic field for correcting vertical misconvergence between said center electron beam and said both side electron beams, and a driving circuit for supplying an exciting current to the third coil;

a second convergence yoke disposed in a different position from said first convergence yoke on the neck part of said cathode-ray tube; and a fourth coil wound on said second convergence yoke for generating a magnetic field for correcting vertical misconvergence between said both side electron beams, and a driving circuit for supplying an exciting current to the fourth coil;

wherein said first convergence yoke comprises two cores, each core having two magnetic poles, said first coil is wound on two magnetic poles of one of said two cores, said second coil is wound on two magnetic poles of the other of said two cores, and said third coil is wound on said two cores.

4. A system according to claim 3 wherein said first coil comprises series connected coils wound on two magnetic poles of said one of said two cores, said second coil comprises series connected coils wound on two magnetic poles of said other of said two cores, and said third coil comprises series connected coils wound on said two cores.

5. A system for generating magnetic fields to converge a plurality of electron beams in a cathode-ray tube comprising:

magnetic pole pieces disposed on both sides of a center electron beam opposing each other for forming magnetic paths inside the neck part of said cathode-ray tube;

a first convergence yoke disposed on the outside of the neck part of said cathode-ray tube for forming magnetic paths together with said magnetic pole pieces;

a first coil wound on said first convergence yoke for generating a magnetic field for correcting horizontal misconvergence between said center electron beam and a side electron beam located on a aside of said center electron beam, and a driving circuit for supplying an exciting current to the first coil;

a second coil wound on said first convergence yoke for generating a magnetic field for correcting horizontal misconvergence between said center electron beam and a side electron beam located on the other side of said center electron beam, and a driving circuit for supplying an exciting current to the second coil;

a third coil wound on said first convergence yoke for generating a magnetic field for correcting vertical misconvergence between said center election beam and said both side electron beams, and a driving circuit for supplying an exciting current to the third coil;

a second convergence yoke disposed in a different position from said first convergence yoke on the neck part of said cathode-ray tube; and a fourth coil wound on said second convergence yoke for generating a magnetic field for correcting vertical misconvergence between said both side electron beams, and a driving circuit for supplying an exciting current to the fourth coil;

wherein said system further comprises a fifth coil wound on said first convergence yoke, a vertical deflection current being made to flow through the fifth coil.

6. A system according to claim 5 wherein said first convergence yoke has a ring shaped outer periphery and four magnetic poles on its inner periphery, and said fifth coil is wound on said four magnetic poles.

7. A system according to claim 6 wherein said fifth coil comprises coils wound on said four magnetic poles of said first convergence yoke and connected in series.

8. A system for generating magnetic field for converging a plurality of electron beams in a cathode-ray tube comprising:

magnetic pole pieces disposed on both sides of the center electron beam opposing to each other for forming magnetic paths inside the neck part of said cathode-ray tube:

a convergence yoke disposed on the outside of the neck part of said cathode-ray tube for forming magnetic paths together with said magnetic pole pieces;

a first coil wound on said convergence yoke for generating a magnetic field for correcting horizontal misconvergence between said center electron beam and a side electron beam on a side of the center electron beam, and a driving circuit for supplying an exciting current to the first coil;

a second coil wound on said convergence yoke for generating a magnetic field for correcting horizontal misconvergence between said center electron beam and a side electron beam on the other side of the center electron beam, and a driving circuit for supplying an exciting current to the second coil;

a third coil wound on said convergence yoke for generating a magnetic field for correcting vertical misconvergence between said center electron beam and said both side electron beams, and a driving circuit for supplying an exciting current to the third coil; and a fourth coil wound on said convergence yoke for generating a magnetic field for correcting vertical misconvergence between said both side electron beams, and a driving circuit for supplying an exciting current to the fourth coil;

wherein said convergence yoke comprises a core having a ring shaped outer periphery and having six magnetic poles on tis inner periphery, said fourth coil is wound on two magnetic poles opposing to each other in a horizontal direction out of said six magnetic poles, said first coil is wound on two magnetic poles out of four magnetic poles except said two magnetic poles opposing to each other in the horizontal direction and having one of said two opposing magnetic poles there between, said second coil is wound on the remaining two magnetic poles out of said four magnetic poles except said two magnetic poles opposing to each other in the horizontal direction and having the other of said two opposing magnetic poles there between, and said third coil is wound on four magnetic poles except said two magnetic poles opposing to each other in the horizontal direction.

9. A system according to claim 8 wherein said fourth coil comprises coils connected in series and wound, on said two magnetic poles opposing to each other in the horizontal direction, said first coil comprises coils connected in series and wound on said two magnetic poles out of said four magnetic poles except said two magnetic poles opposing to each other in the horizontal direction, said second coil comprises coils connected in series and wound on said remaining two magnetic poles out of said four magnetic poles except said two magnetic poles opposing to each other in horizontal direction, and said third coil comprises coils connected in the series and wound on said four magnetic poles except said two magnetic poles opposing to each other in horizontal direction.

10. A system for generating magnetic fields to converge a plurality of electron beams in a cathode-ray tube comprising:

magnetic pole pieces disposed on both sides of a center electron beam opposing each other for forming magnetic paths inside the neck part of said cathode-ray tube;

a first convergence yoke disposed on the outside of the neck part of said cathode-ray tube for forming magnetic paths together with said magnetic pole pieces;

a first coil wound on said first convergence yoke for generating a magnetic field for correcting horizontal misconvergence between said center electron beam and a side electron beam located on a side of said center electron beam, and a driving circuit for supplying an exciting current to the first coil;

a second coil wound on said first convergence yoke for generating a magnetic field for correcting horizontal misconvergence between said center electron beam and a side electron beam located on the other side of said center electron beam, and a driving circuit for supplying an exciting current to the second coil;

a third coil wound on said first convergence yoke for generating a magnetic field for correcting vertical misconvergence between said center electron beam and said both side electron beams, and a driving circuit for supplying an exciting current on the third coil;

a second convergence yoke disposed in a different position form said first convergence yoke on the neck part of said cathode-ray tube; and a fourth coil wound on said second convergence yoke for generating a magnetic field for correcting vertical misconvergence between said both side electron beams, and a driving circuit for supplying an exciting current to the fourth coil;

wherein said first convergence yoke having said first, second and third coils wound thereon, each of said coils receiving an exciting current from a respective driving circuit, and the second convergence yoke having the fourth coil wound thereon and receiving an exciting current from the associated driving circuit enable the convergence system to act on respective ones of the center and side electron beams independently of one another.

* * * * *